US007991329B2

(12) United States Patent
Yamada et al.

(10) Patent No.: US 7,991,329 B2
(45) Date of Patent: Aug. 2, 2011

(54) DEVELOPER APPARATUS, IMAGE FORMING APPARATUS AND DEVELOPING METHOD

(75) Inventors: Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 294 days.

(21) Appl. No.: 12/247,117

(22) Filed: Oct. 7, 2008

(65) Prior Publication Data

US 2009/0110442 A1 Apr. 30, 2009

(30) Foreign Application Priority Data

Oct. 26, 2007 (JP) ..... 2007-278967

(51) Int. Cl.
*G03G 15/01* (2006.01)

(52) U.S. Cl. ..... 399/227; 399/259; 399/284

(58) Field of Classification Search ..... 399/227, 399/259, 279, 284, 287
See application file for complete search history.

(56) References Cited

U.S. PATENT DOCUMENTS

| | | | | |
|---|---|---|---|---|
| 6,094,554 | A | 7/2000 | Ichikawa et al. | |
| 6,151,474 | A | 11/2000 | Ichikawa et al. | |
| 6,163,674 | A | 12/2000 | Ichikawa et al. | |
| 6,192,209 | B1 | 2/2001 | Ichikawa et al. | |
| 6,198,893 | B1 | 3/2001 | Ichikawa et al. | |
| 6,226,484 | B1 | 5/2001 | Ichikawa et al. | |
| 6,295,433 | B1 | 9/2001 | Ichikawa et al. | |
| 6,336,022 | B2 | 1/2002 | Ichikawa et al. | |
| 7,149,440 | B2 | 12/2006 | Arai | |
| 7,211,361 | B2 | 5/2007 | Arai | |
| 2006/0171737 | A1 * | 8/2006 | Nishimura et al. | 399/109 |
| 2007/0110484 | A1 * | 5/2007 | Yamada et al. | 399/286 |

FOREIGN PATENT DOCUMENTS

| | | | |
|---|---|---|---|
| JP | 06-138774 | | 5/1994 |
| JP | 10-239895 | A | 9/1998 |
| JP | 2003-057940 | | 2/2003 |
| JP | 2004-126094 | A | 4/2004 |
| JP | 2007-121948 | | 5/2007 |
| JP | 2007-121950 | | 5/2007 |
| JP | 2007-127800 | | 5/2007 |
| JP | 2007121949 | A | 5/2007 |
| JP | 2007-140080 | | 6/2007 |
| JP | 2007-199423 | A | 8/2007 |
| JP | 2007199424 | A | 8/2007 |
| JP | 2007-271951 | A | 10/2007 |

OTHER PUBLICATIONS

European search report for corresponding European application 08018387.4-2209.

* cited by examiner

*Primary Examiner* — David M Gray
*Assistant Examiner* — Barnabas T Fekete
(74) *Attorney, Agent, or Firm* — DLA Piper LLP (US)

(57) ABSTRACT

A developer apparatus, includes: a container which houses toner; a toner carrier roller which is provided, on a surface thereof, with a plurality of convex sections which are regularly arranged and a concave section which surrounds the convex sections, is shaped approximately like a cylinder, and rotates while carrying a toner layer of charged toner supplied from the container on the surface thereof; and a restriction member which abuts on the toner layer on the surface of the toner carrier roller to restrict a thickness of the toner layer, and restricts the toner layer carried by the convex sections within the surface of the toner carrier roller to one layer or less.

11 Claims, 14 Drawing Sheets

DEVELOPER APPARATUS, IMAGE FORMING APPARATUS AND DEVELOPING METHOD

CROSS REFERENCE TO RELATED APPLICATION

The disclosure of Japanese Patent Application No. 2007-278967 filed on Oct. 26, 2007 including specification, drawings and claims is incorporated herein by reference in its entirety.

BACKGROUND

1. Technical Field

The present invention relates to a developer apparatus which comprises a toner carrier roller which carries toner on a surface thereof, an image forming apparatus and a developing method of developing an electrostatic latent image with toner using this roller.

2. Related Art

Techniques for developing an electrostatic latent image with toner include an apparatus which causes a surface of a toner carrier roller to carry toner, the toner carrier roller being shaped approximately like a cylinder. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-127800). Since the concavo-convex patterns in the surface are regulated and uniform, such a structure is advantageous in that it permits easy control of the thickness of a toner layer which is carried on the surface of the roller, the charge level and the like.

SUMMARY

However, in the case where a toner carrier roller having the structure above is used, owing to the evenness of the convexo-concave, scattering of toner from the surface of the toner carrier roller, fog and the like will be a problem unless a toner layer thickness on the toner carrier roller is strictly controlled. According to research by the inventors of the invention, one of the primary causes of these phenomena appears to be that when old toner whose characteristics have degraded in accordance with use is present together with new toner having excellent characteristics, the old toner tends to be carried particularly in a far layer from the surface of the toner carrier roller. In a toner layer far from the surface of the toner carrier roller, adhesion of toner to the toner carrier roller is weak. Hence, it is considered that leakage and scattering of toner and fog are easy to occur.

An advantage of some aspects of the invention is to provide technology for reducing leakage and scattering of toner from a toner carrier roller, fog and the like in a developer apparatus, an image forming apparatus and a developing method which use a toner carrier roller whose surface is provided with convexoconcave.

According to a first aspect of the invention, there is provided a developer apparatus, comprising: a container which houses toner; a toner carrier roller which is provided, on a surface thereof, with a plurality of convex sections which are regularly arranged and a concave section which surrounds the convex sections, is shaped approximately like a cylinder, and rotates while carrying a toner layer of charged toner supplied from the container on the surface thereof; and a restriction member which abuts on the toner layer on the surface of the toner carrier roller to restrict a thickness of the toner layer, and restricts the toner layer carried by the convex sections within the surface of the toner carrier roller to one layer or less.

According to a second aspect of the invention, there is provided an image forming apparatus, comprising: an image carrier which carries an electrostatic latent image; and a developer which develops the electrostatic latent image carried by the image carrier with toner and includes a toner carrier roller which is provided, on a surface thereof, with a plurality of convex sections which are regularly arranged and a concave section which surrounds the convex sections, is shaped approximately like a cylinder, and carries a toner layer of charged toner on the surface thereof, wherein the toner layer carried by the convex sections within the surface of the toner carrier roller is comprised of one layer or less.

According to a third aspect of the invention, there is provided a developing method, comprising: arranging an approximately cylindrical toner carrier roller, which carries a toner layer of charged toner on a surface thereof, opposed to an image carrier which carries an electrostatic latent image, the toner carrier roller being provided, on the surface thereof, with a plurality of convex sections which are regularly arranged and a concave section which surrounds the convex sections; developing the electrostatic latent image carried by the image carrier with toner; and restricting the toner layer carried by the convex sections within the surface of the toner carrier roller to one layer or less.

The findings of the inventors of the invention based on various experiments, although will be described in detail later, will now be described briefly. Of toner carried by the surface of a toner carrier roller, new toner having excellent characteristics (hereinafter referred to as "new toner") gathers near the surface of the toner carrier roller, whereas toner whose characteristics have degraded with long use (hereinafter referred to as "old toner") is contained in concentrated amounts in toner which is on top of the new toner and which is carried as it is separated from the surface of the toner carrier roller. In other words, a toner layer made mainly of new toner is formed first on the surface of the toner carrier roller, and another toner layer containing a big amount of old toner is formed on the surface of the previous toner layer. Such old toner, owing to its reduced contact with the toner carrier roller, is not charged sufficiently, and hence, may leak, scatter or cause fog.

Noting this, according to the invention, a toner layer carried by convex sections in a surface of a toner carrier roller is restricted to one layer or less using a restriction member. This will ensure that toner carried on the surface of the toner carrier roller has favorable characteristics. Hence, it is possible to suppress scattering of toner, fog, and the like.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 6A through 6D are diagrams showing a model for describing a mechanism of toner scattering and the like.

DESCRIPTION OF EXEMPLARY EMBODIMENTS

Figure 1:
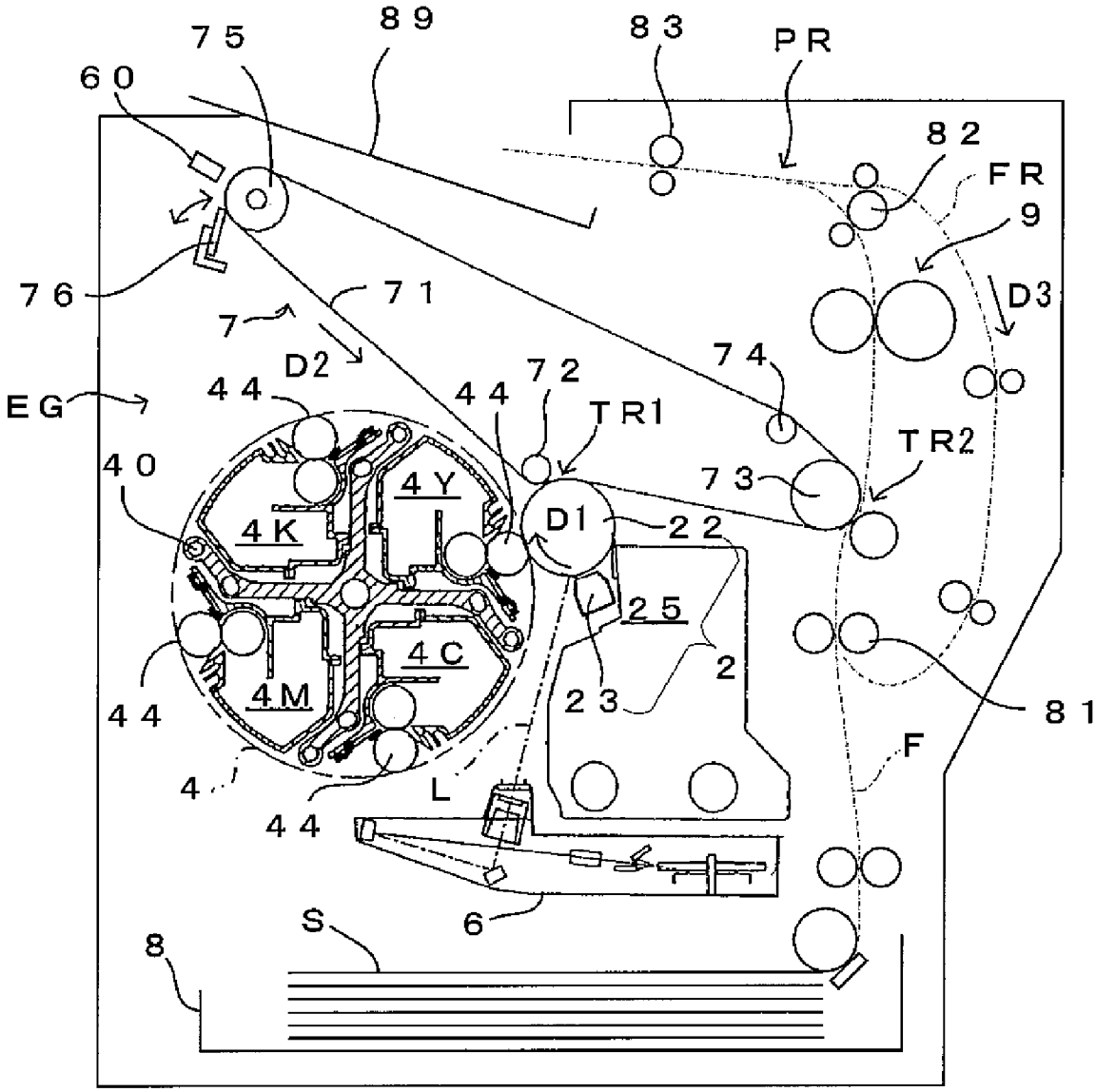
FIG. 1 is a diagram showing an embodiment of an image forming apparatus according to the invention.
Figure 2:
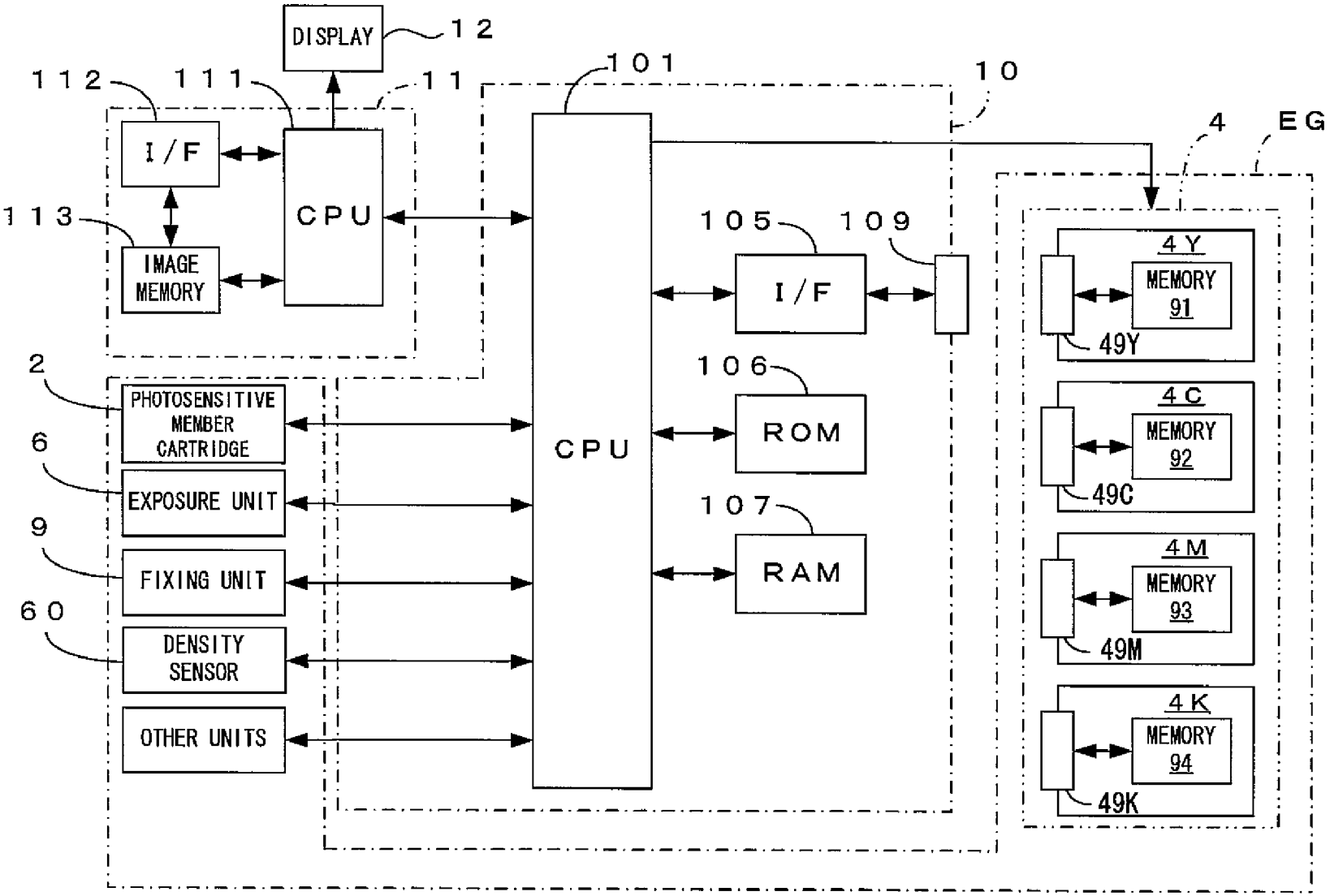
FIG. 2 is a block diagram of an electric structure of the image forming apparatus which is shown in FIG. 1.

FIG. 1 is a diagram showing an embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a fall-color image, or forms a monochrome image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which abuts on the photosensitive member 22 or is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
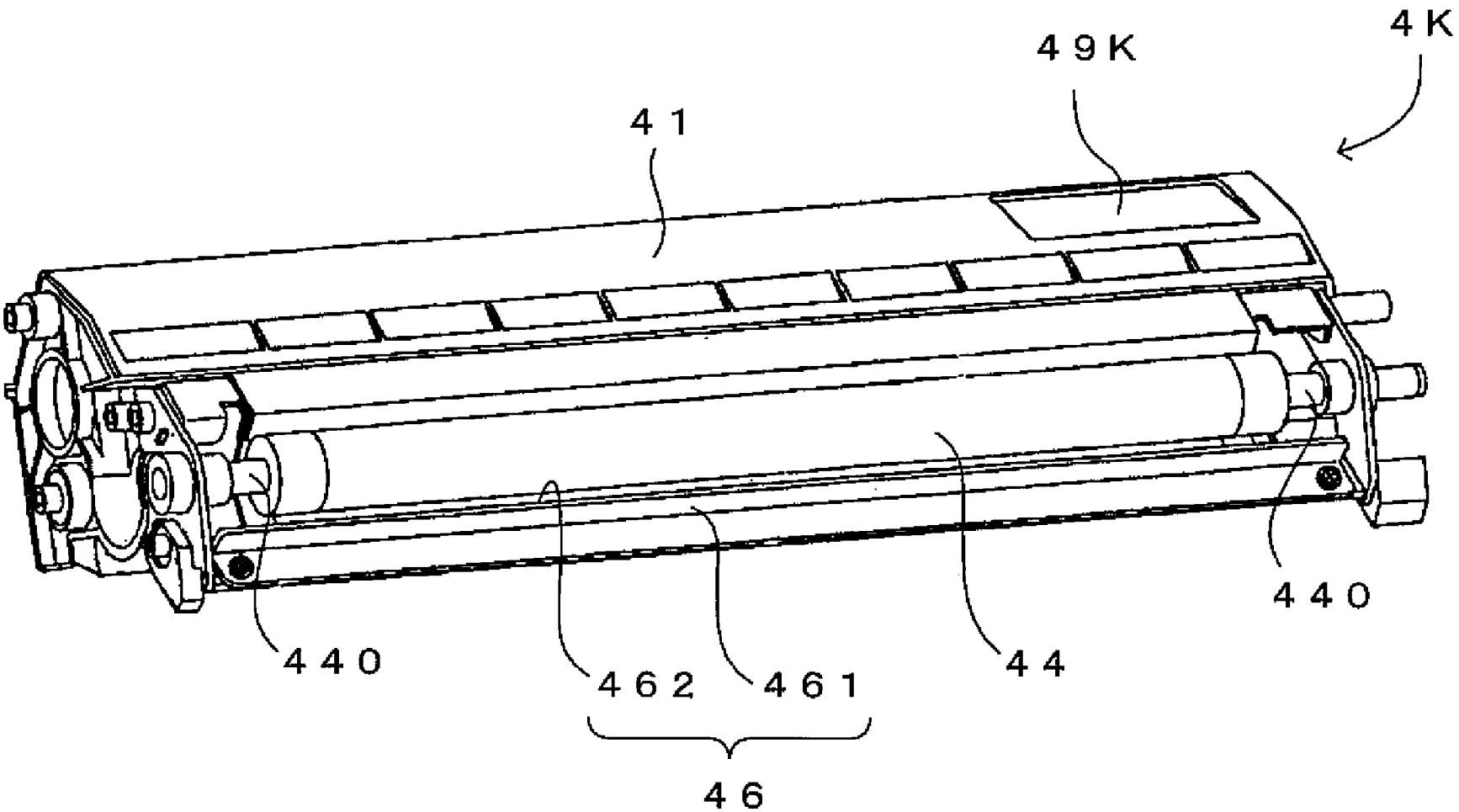
FIG. 3 is a diagram showing the appearance of the developer.
Figure 4:
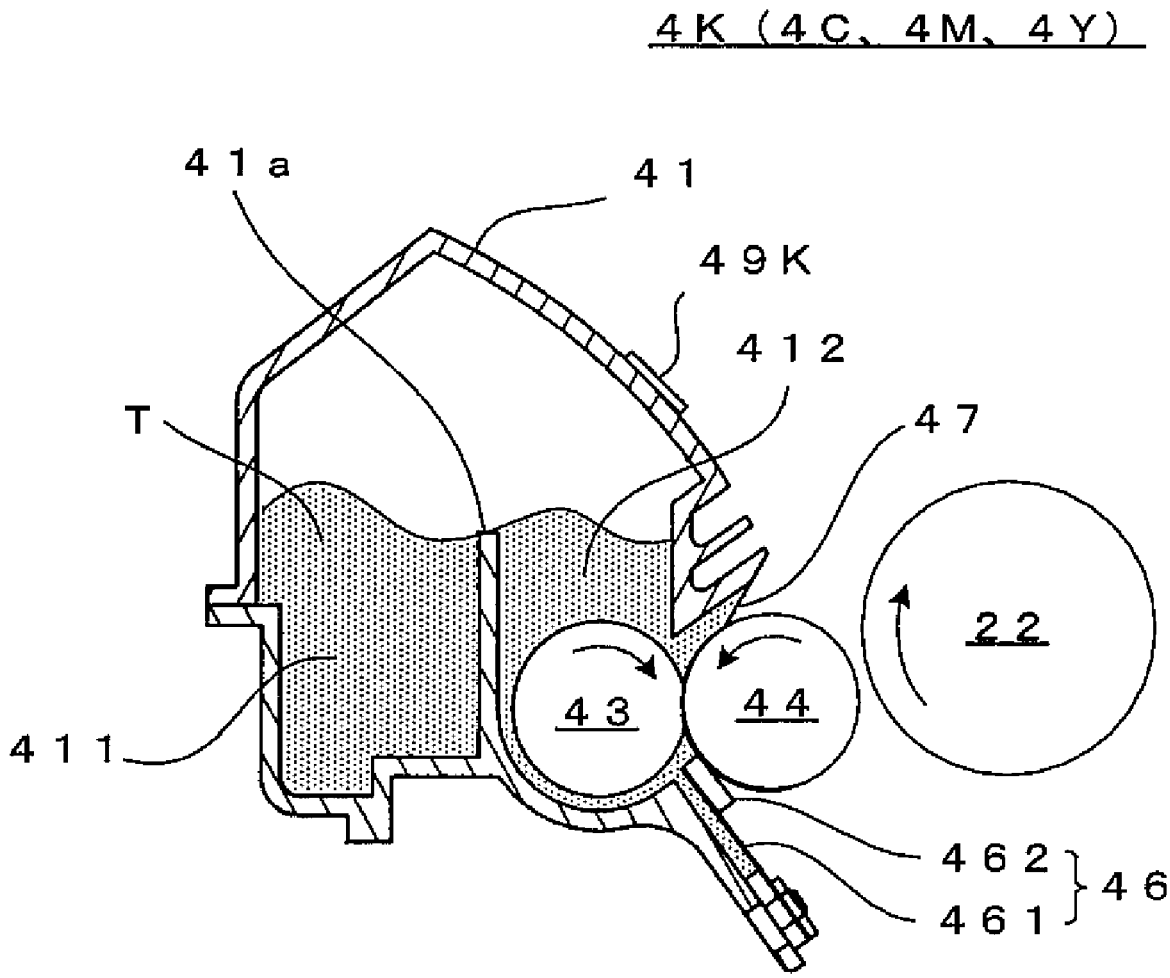
FIG. 4 is a cross sectional view showing a structure of the developer.

FIG. 3 is a diagram showing the appearance of the developer. FIG. 4 is a cross sectional view showing a structure of the developer. The developers 4Y, 4C, 4M and 4K have identical structures. Therefore, the structure of the developer 4K will now be described in further detail with reference to FIGS. 3 and 4. The other developers 4Y, 4C and 4M have the same structures and functions, to be noted. In the developer 4K, a feed roller 43 and a developing roller 44 are rotatably attached with a shaft to a housing 41 which houses toner T inside. When the developer 4K is positioned at the developing position described above, the developing roller 44 is positioned at a facing position which abuts on the photosensitive member 22 or is faced with the photosensitive member 22 over a predetermined gap, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction of the developing roller 44 shown by an arrow in FIG. 4. The elastic member 462 elastically abuts on the surface of the developing roller 44, thereby restricting the toner layer formed on the surface of the developing roller 44 finally into the predetermined thickness.

The toner layer thus formed on the surface of the developing roller 44 is gradually transported, by the rotation of the developing roller 44, to an opposed position facing the photosensitive member 22 on a surface of which the electrostatic latent image has been formed. When a developing bias from a bias power source not shown is applied upon the developing roller 44, the toner carried on the developing roller 44 partially adheres to respective portions within the surface of the photosensitive member 22 in accordance with a surface potential thereof. The electrostatic latent image on the photosensitive member 22 is visualized as a toner image in this toner color in this manner.

The housing 41 further includes a seal member 47 which is pressed against the surface of the developing roller 44 on the downstream side to the opposed position facing the photosensitive member 22 in the rotation direction of the developing roller 44. The seal member 47 guides toner which remains on the surface of the developing roller 44 after moving past the opposed position facing the photosensitive member 22 to inside the housing 41 and prevents toner inside the housing from leaking to outside.

Figure 5:
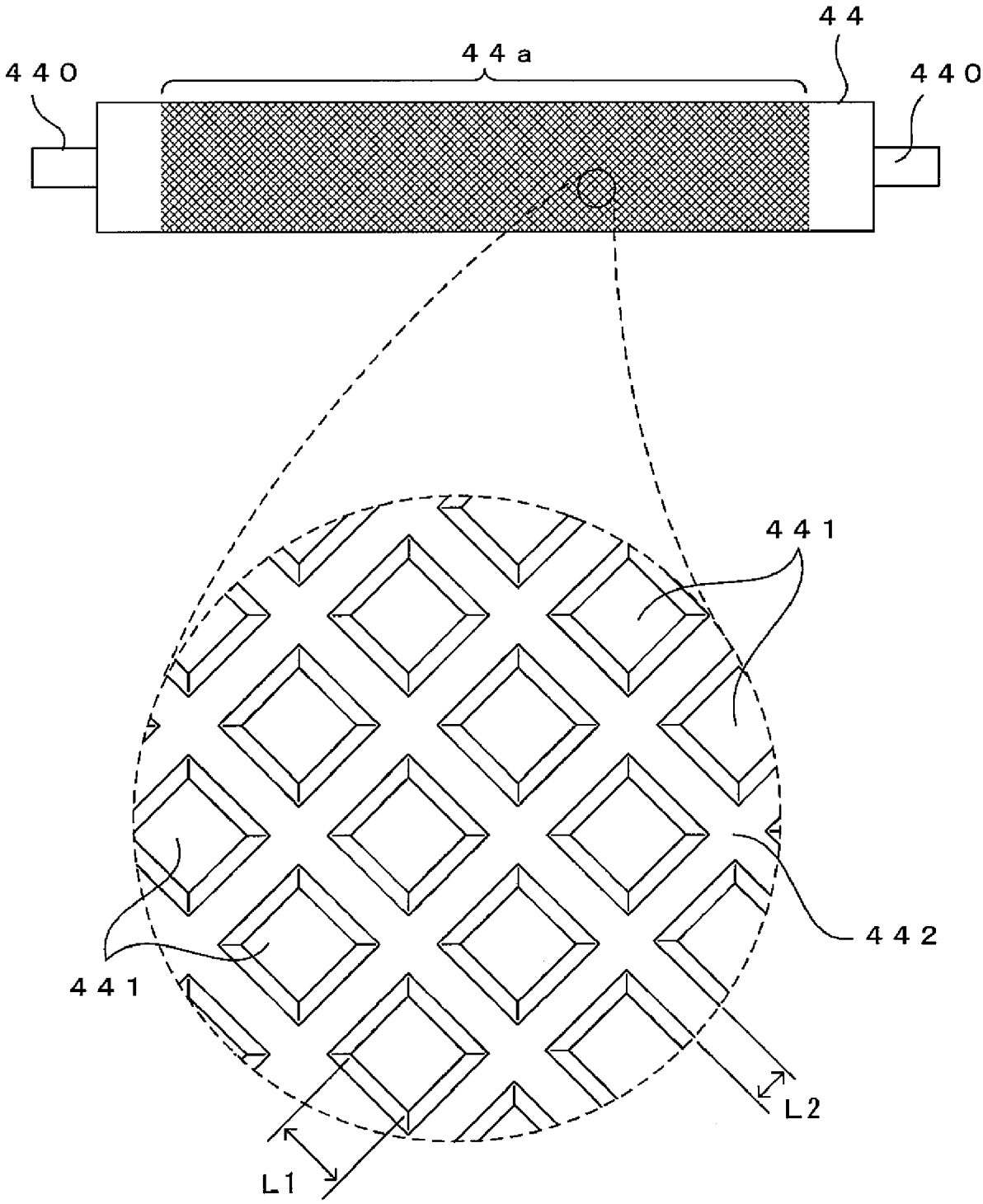
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotation shaft of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotation shaft of the developing roller 44. The developing roller 44 having such a structure may be made by the manufacturing method described in JP-A-2007-140080 for instance.

The length L1 of a side of the top surface of each convex section 441 and a distance L2 between the respective convex sections may be but are not limited to 10 through 100 μm approximately for instance. The shape, the arrangement and the like of the convex sections 441 are not limited to those described here. A difference in height between the convex sections 441 and the concave section 442 will be described later.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed.

However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus such as a host computer via the interface 112. A reference numeral 106 represents a ROM for storage of an operation program executed by the CPU 101 and control data used for controlling the engine part EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

A detailed description will now be given on restriction of toner layers on the developing roller 44 in the developer 4K, . . . of the image forming apparatus having the structure described above. In the developer 4K, . . . of this image forming apparatus, the feed roller 43 abuts on the surface of the developing roller 44 inside the housing 41 which contains toner T as described earlier. Further, the restriction blade 46 abuts on a toner layer which is on the developing roller at the downstream side with respect to a feed roller abutting position in the rotation direction of the developing roller, and accordingly, the thickness of the toner layer which is carried on the surface of the developing roller 44 is regulated. When the thickness is not appropriate, the image forming operation will be influenced. Specifically, when the toner layer is too thin, the amount of toner transported to the opposed position facing the photosensitive member 22 will be a little and a sufficient image density will not be obtained. On the other hand, when the toner layer is too thick, toner may fall off from the surface of the developing roller 44 and leak inside the apparatus, may scatter around from the developing roller as a cloud, and may adhere onto the photosensitive member 22 to cause fog. These phenomena will hereinafter be referred to as "toner scattering and the like".

First, the principle of toner layer restriction in this embodiment will be described. In a condition that a relatively thick toner layer (that is, the thickness being approximately a several times as large as the volume average particle diameter of toner) was formed, the inventors of the invention conducted various experiments upon the causal correlation between the condition of the surface of the developing roller 44 on which the toner layer is formed and toner scattering and the like. As a result, it has become clear that the model below would explain the mechanism of toner scattering and the like.

Figure 6A:
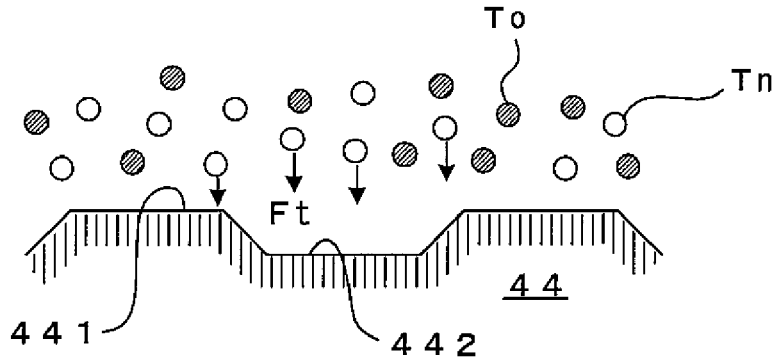

FIGS. 6A through 6D are diagrams showing a model for describing a mechanism of toner scattering and the like. The developer is filled with new toner initially. However, as the image forming operation using the developer is repeatedly executed, the developer contains a mixture of unused toner maintaining its initial characteristics (referred to as "new toner" in the specification) and used toner having degraded characteristics since it has been returned back into inside the developer without being used for development although it was once carried on the surface of the developing roller 44 (referred to as "old toner" in the specification). Hence, there are new toner Tn and old toner To mixed together around the developing roller 44 as shown in FIG. 6A. In FIGS. 6A through 6D, white circles denote the new toner Tn and circles with hatching denote the old toner To.

Figure 6B:
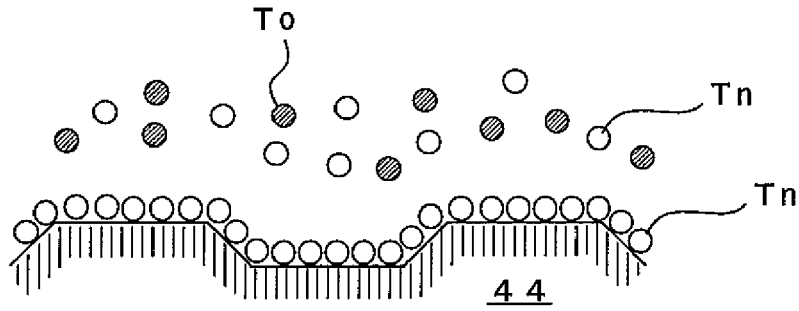

Out of these, new toner Tn, having high fluidity and a high charge level, is attracted toward the surface of the developing roller 44 due to electrostatic force Ft. On the other hand, old toner is inferior to new toner in terms of fluidity and charging characteristics because of burying, separation or the like of an additive, and hence, the power and the speed attracted to the developing roller 44 of old toner are weaker and slower than those of new toner. As a result, toner directly contacting the developing roller 44 is mostly new toner Tn as shown in FIG. 6B. In short, of toner layers formed on the surface of the developing roller 44, the first layer which is the closest to the developing roller 44 is made of new toner.

Figure 6C:
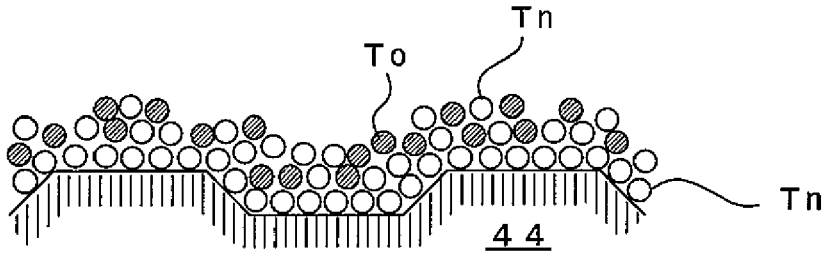

On the other hand, in a layer deposited upon the first layer thus formed, new toner Tn and old toner To are mixed together as shown in FIG. 6C. This is because coating of the surface of the developing roller 44 with a layer of new toner weakens the influence of the electrostatic force of the developing roller itself upon a layer over the new toner layer, and the electric charge of new toner attracts other toner, and hence, attracts not only new toner but also old toner which has a lower charge level or is charged to the opposite polarity due to deterioration. In this specification, the phenomenon that new toner is concentrated inside a layer near the surface of the developing roller 44, whereas a layer far from this surface contains a lot of old toner will be referred to as "layer separation phenomenon".

Figure 6D:
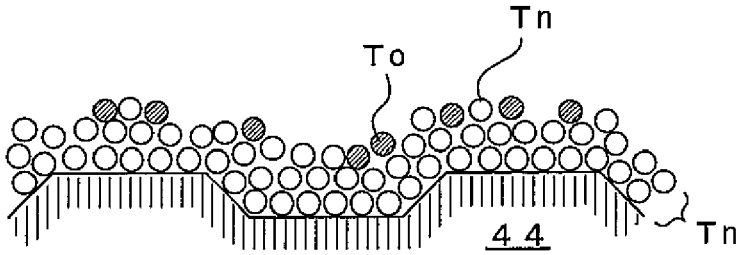

Meanwhile, depending upon the electrostatic force of the developing roller 44 and the charging characteristics of toner itself, two or more layers of new toner may be formed on the surface of the developing roller 44 as shown in FIG. 6D. In such an instance as well, new toner Tn and old toner To are mixed together in a layer far from the surface of the developing roller 44 and layer separation phenomenon occurs.

As described above, of toner layers formed on the surface of the developing roller 44, in an outer layer far from the developing roller 44, the rate of old toner To is higher. Old toner To only weakly adheres to the surface of the developing roller 44 or to a toner layer on this surface since it has a low charge level. As a result, old toner To falls off from the surface of the developing roller 44 and scatters inside the apparatus while being transported by the rotation of the developing roller 44. Further, toner charged to the polarity opposite to the intended polarity adheres to a region of an electrostatic latent image on the photosensitive member 22 to which toner is not supposed to adhere, and causes fog.

This model can explain the following experimental fact. For example, when a developer containing only a little remaining toner after being used over a long period of time was filled with new toner, the occurrence of toner scattering, fog and the like temporarily increases but gradually decreases thereafter. The reason of this appears to be that mixing of a great amount of new toner with degraded toner inside the developer resulted in dominant presence of new toner near the surface of the developing roller 44 and a large amount of old toner in the outer-most surface of a toner layer. It appears that during continued use, new toner would be selectively used, which would reduce a difference of the characteristics of new toner from those of old toner, relieve the layer separation phenomenon and eventually decrease the degree of toner scattering and the like.

This is backed by an experiment of replenishing toner of a different color from an original toner color. The surface of the developing roller 44 was observed after replenishing yellow toner in the cyan developer 4C inside of which a remaining toner amount was small, for instance. As a result, a toner layer of a greenish color resulted from mixing of cyan toner and yellow toner was formed on the surface of the developing roller. However, when the surface toner was removed with blown air, through brushing off or by otherwise appropriate method, the color of the surface of the developing roller 44 changed to yellow gradually. To be noted in particular, toner in the first layer directly contacting the surface of the developing roller 44 had a yellow color which was almost the same as the original color of the yellow toner. On the other hand, when the image forming operation was executed using this developer, it was primarily cyan toner that was scattered around the developer or caused fog on the photosensitive member 22.

From these results, it turns out that layer separation phenomenon occurs in which a layer near the surface of the developing roller 44 is dominated by new toner, whereas a layer far from the surface contains a large amount of old toner, and that it is principally old toner that causes toner scattering and the like.

Meanwhile, the terms "new toner" and "old toner" used herein express a concept regarding relative differences in terms of characteristics among toner particles inside the developer, and therefore, are not necessarily relevant to whether toner itself is fresh or not. For example, even fresh toner may contain some amount of toner whose characteristics are inadequate like old toner described above, in which case such toner would act like "old toner". Further, even toner which is not fresh toner can be considered to be "new toner" if relative differences in terms of characteristics among toner particles are small.

A similar phenomenon could occur even when the developers do not have slots for replenishing toner, not to mention when the developers have such slots. In the case where the developer is partitioned into two or more chambers and toner is fed from one chamber to other chamber at a certain timing as in the embodiment for example, new toner gets mixed with old toner at a timing of feeding of toner from one chamber to other chamber. Although no auger is provided inside the developers in this embodiment, when the developer 4K, . . . rotates in accordance with rotation of the rotary developer unit 4, new toner stored in the first chamber 411 flows into the second chamber 412 which contains old toner at an increased ratio and gets mixed with the old toner. This remains unchanged in a structure where a toner transportation mechanism such as an auger is disposed inside a developer, and a structure where toner is replenished regularly from a toner tank which is disposed separately from a developer.

One can see from the above that prevention of layer separation phenomenon in a toner layer carried by the developing roller 44 is effective in reducing toner scattering and the like. It is ideal to form a uniform toner layer of new toner all over the surface of the developing roller 44 as shown in FIG. 7.

Figure 7:
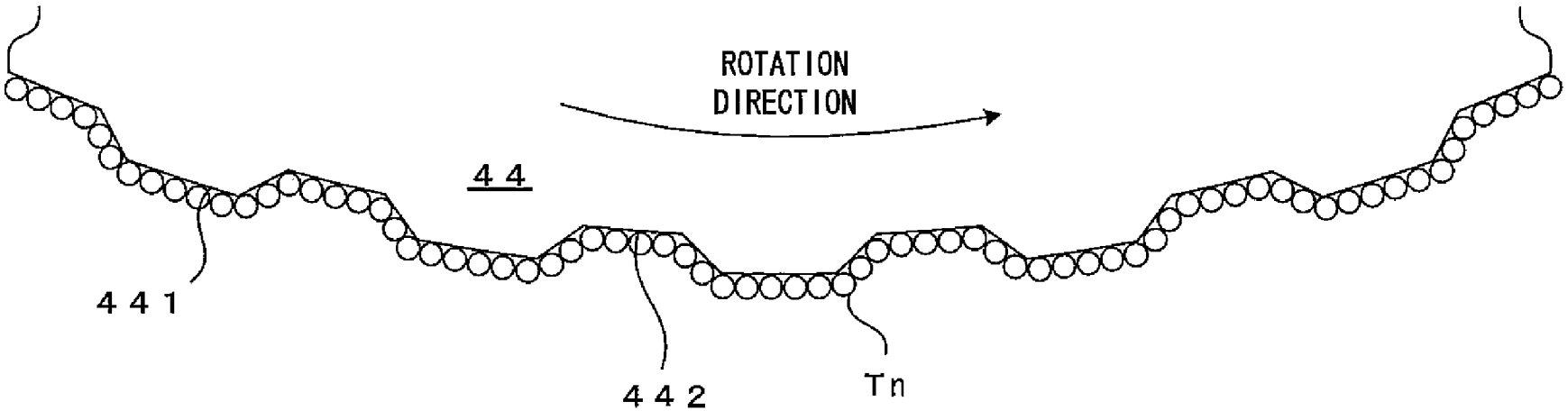
FIG. 7 is a diagram showing an ideal toner layer.

FIG. 7 is a diagram showing an ideal toner layer. In FIG. 7, the case where a toner layer of one layer consisting only of new toner is formed on the convex sections 441 and the concave section 442 in the surface of the developing roller 44 is shown. However, the toner layer may be two or more layers consisting of new toner. Further, from a perspective of simple suppression of toner scattering and the like, a uniform thickness of a toner layer is not an essential requirement. That is, the thickness of the toner layer may change between the convex sections 441 and the concave section 442 for example. However, the toner layer is required not to contain old toner as much as possible. In this embodiment, with the position of the restriction blade 46 relative to the developing roller 44 adjusted and the distance between the tip end of the restriction blade 46 and the developing roller 44 (wedge height) adjusted, a toner layer carried by the developing roller 44 is restricted.

Figure 8:
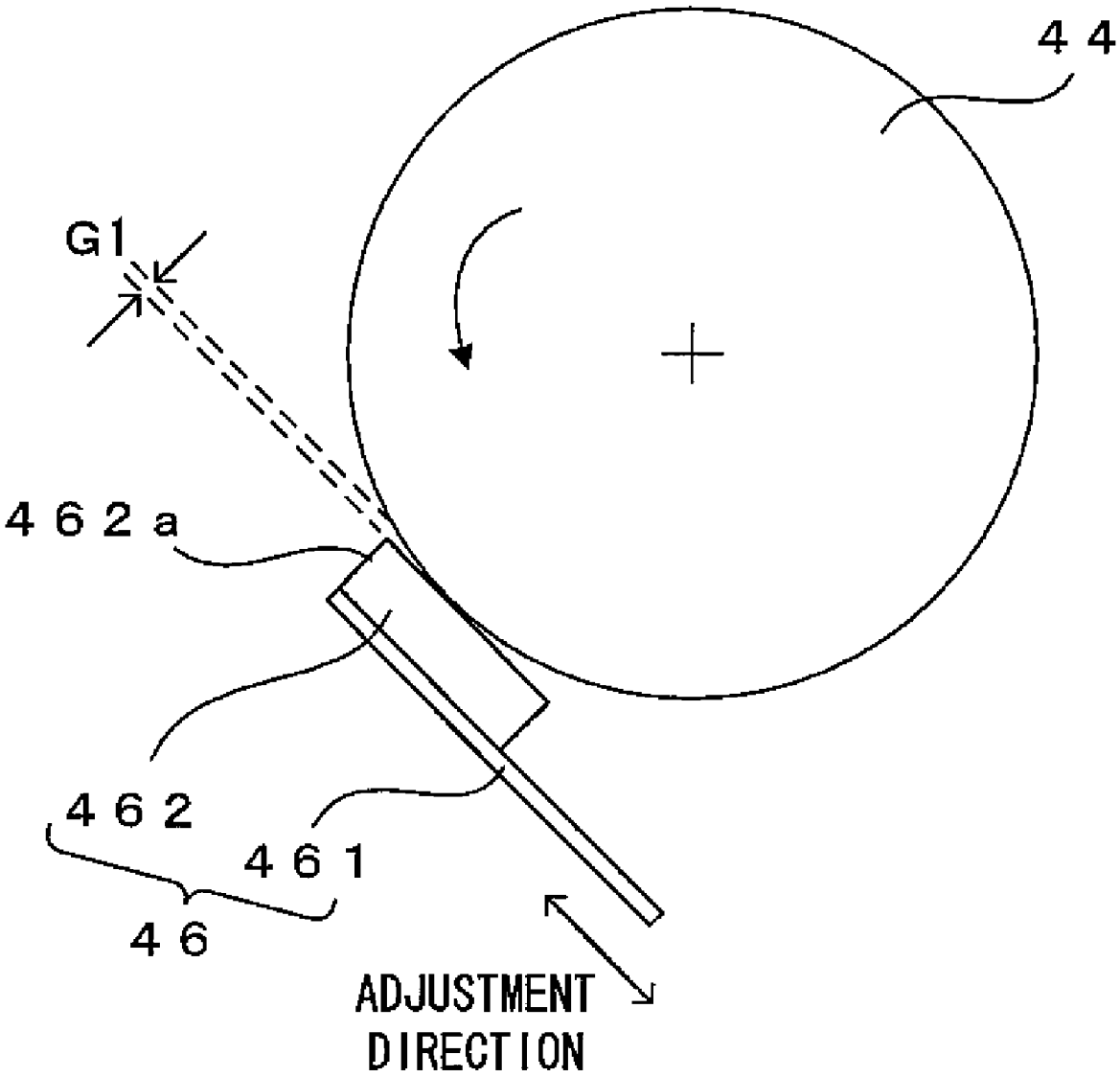
FIG. 8 is a diagram showing a positional relationship between the developing roller and the restriction blade.
Figure 9A:
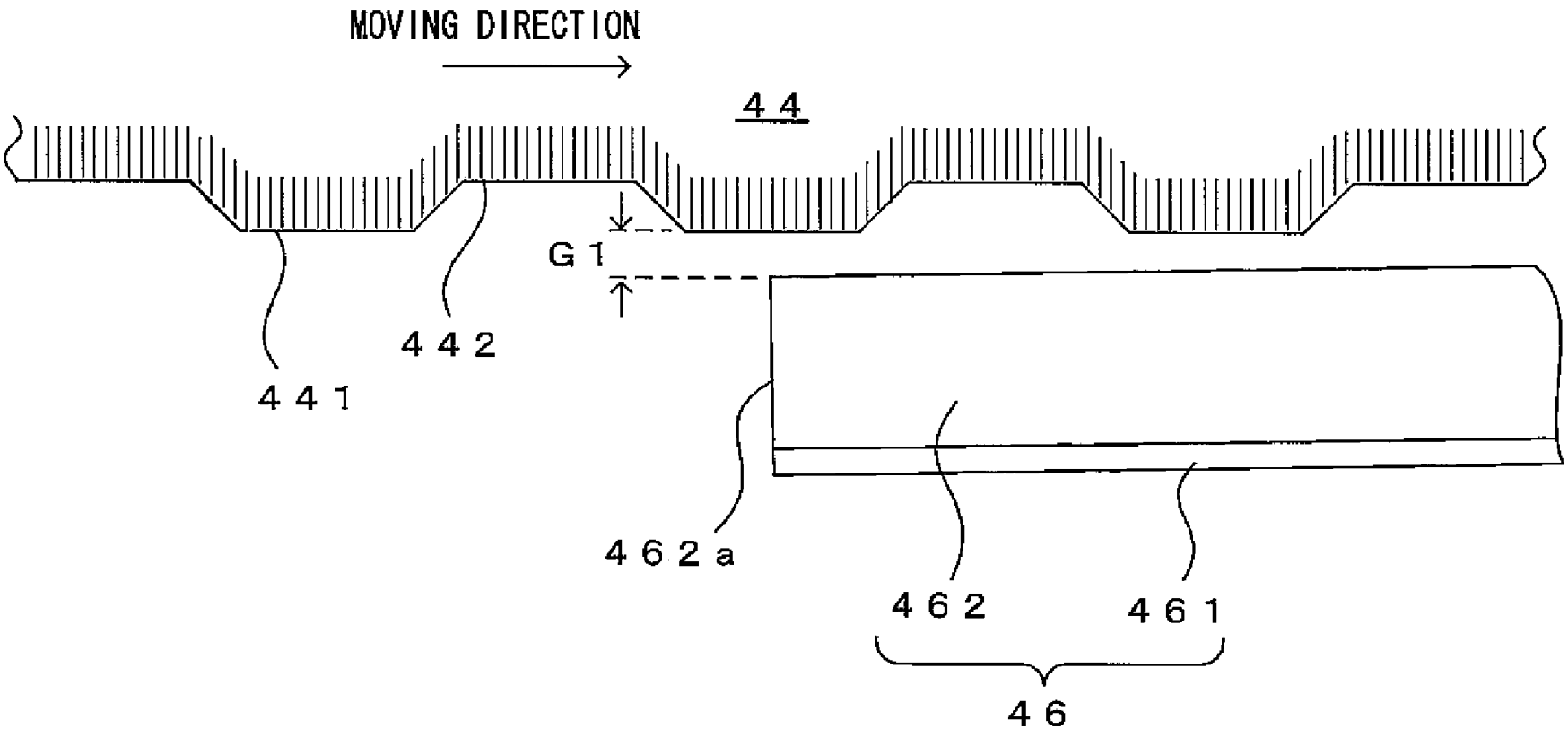
FIGS. 9A and 9B are expanded views schematically showing a portion where the restriction blade abuts on the developing roller.
Figure 9B:
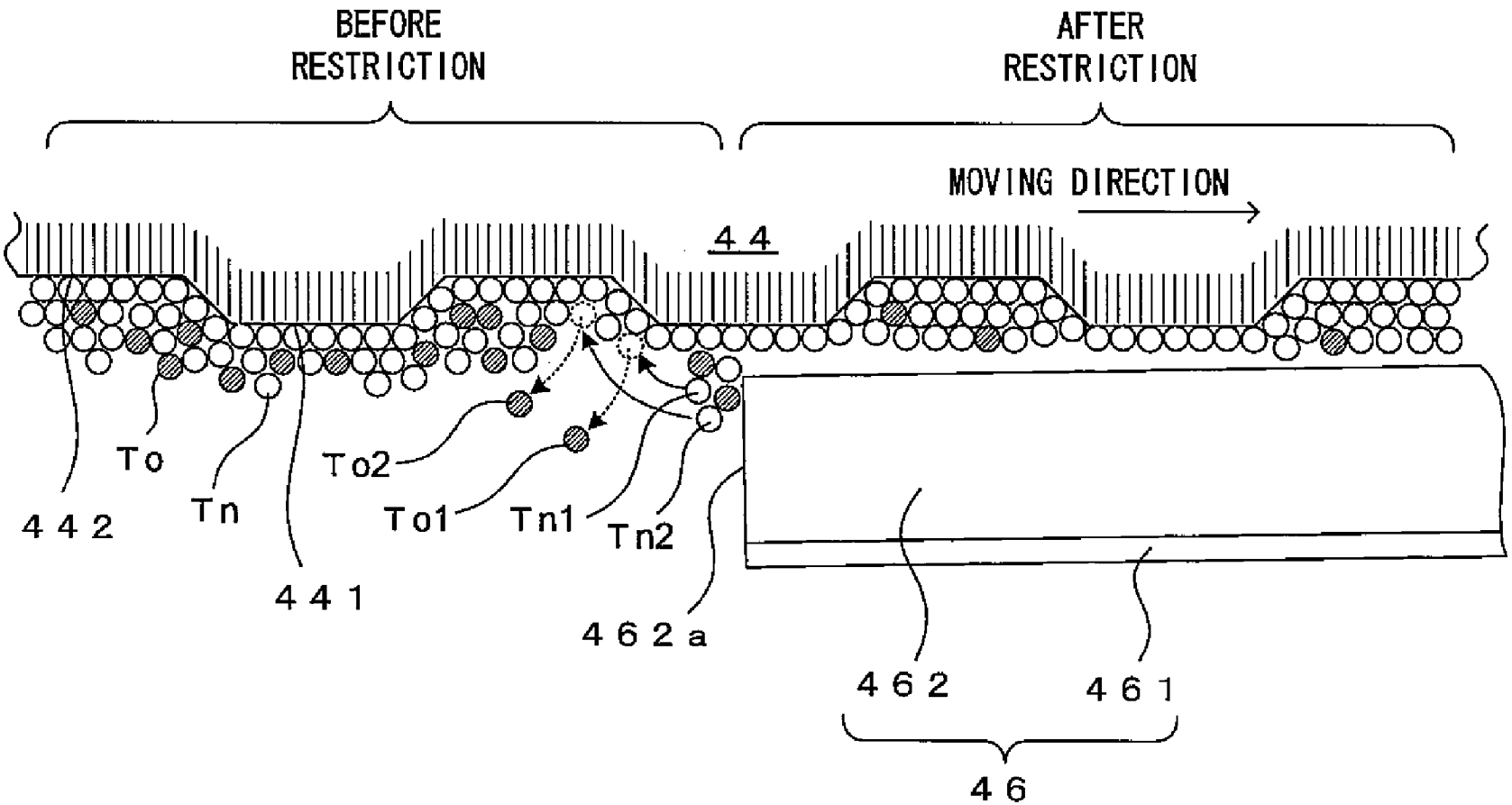

FIG. 8 is a diagram showing a positional relationship between the developing roller and the restriction blade. FIGS. 9A and 9B are expanded views schematically showing a portion where the restriction blade abuts on the developing roller. More specifically, FIG. 9A is a diagram showing a positional relationship between the developing roller 44 and the restriction blade 46 and FIG. 9B is a diagram schematically showing a condition of toner which is carried on the surface of the developing roller 44.

In this embodiment, a distance G1 between an upstream-most edge 462*a* of the elastic member 462 of the restriction blade 46 in the rotation direction of the developing roller and the surface of the developing roller 44 which is the closest to the upstream-most edge 462*a*, more particularly the convex sections 441, is managed, to thereby restrict toner layers carried by the convex sections 441 which are in the surface of the developing roller 44 to one layer or less. Describing this in detail, the distance G1 is set so that the relationship below is satisfied:

$$G1<2\cdot Dave \qquad \text{(Formula 1)}$$

where Dave denotes the volume average particle diameter of toner T. The distance is adjusted by moving a position at which the restriction blade 46 is attached to the housing 41 in an adjustment direction shown in FIG. 8.

Toner layer restriction in such an instance will now be described with reference to FIGS. 9A and 9B. It is to be noted that, in FIGS. 9A and 9B, the direction of the developing roller 44 is opposite to that shown in FIG. 6, that is, the surface thereof is directed toward below. In FIG. 9A, as the developing roller 44 rotates, the surface of the developing roller 44 moves from the left-hand side toward the right-hand side relative to the restriction blade 46 which is fixed. At this time, the distance G1 between the convex sections 441 of the developing roller 44 and the elastic member 462 is set so as to satisfy Formula 1 above, that is, set to a value which is smaller than double the volume average particle diameter Dave of toner.

In a region labeled as "BEFORE RESTRICTION" in FIG. 9B where the toner layers on the developing roller 44 do not reach the abutting position at which they abut on the restriction blade 46 yet, the closest layer to the surface of the developing roller 44 is formed by new toner Tn denoted at white circles, whereas a farther layer (which is located below in FIG. 9B) contains both new toner Tn and old toner To which is shown hatched, as described above. When the toner layers reach the abutting position where they abut on the restriction blade 46 in this condition, the upstream-most edge 462*a* of the elastic member 462 scrapes off the toner which forms the second and farther layers in the convex sections 441. This makes the convex sections 441 carry one layer consisting only of new toner Tn.

New toner and old toner are mixed in the toner scraped off in this manner. New toner Tn of this is under strong electrostatic force which attracts the new toner Tn toward the developing roller 44 since the new toner Tn has a high charge level. Meanwhile, old toner having a low charge level as well is present at an upstream side of the abutting position with the restriction blade 46 in the moving direction of the developing roller 44 (that is, at the left-hand side in FIG. 9B). When the scraped toner collides with such old toner, new toner Tn1 and Tn2 having high charge levels flip old toner To1 and To2 having low charge levels present at the upstream side (at the left-hand side in FIG. 9B) in the moving direction. Thus, the old toner present in the vicinity of the surface of the developing roller 44 is gradually replaced with the new toner Tn and is driven away toward the upstream side (at the left-hand side in FIG. 9B) in the moving direction. As a result, in the region labeled as "AFTER RESTRICTION" in FIG. 9B where layer restriction by the restriction blade 46 has been performed, the rate of the old toner to the total toner which forms the toner layers is extremely low.

On the convex sections 441 in particular, almost all toner is new toner since the toner layer is restricted to one layer or less. On the other hand, in the concave section 442, toner layer of two or more layers can be formed to the extent allowed by the gap between the concave section 442 and the restriction blade 46. However, since old toner is expelled also from these layers as described above, the rate of the old toner to the total toner carried in the concave section 442 can be made sufficiently low.

In contrast, in the case where the distance G1 is double the volume average particle diameter Dave of toner or larger, toner in two or more layers reaches the abutting position with the restriction blade 46 while staying adhered to the convex sections 441. The toner forming the second and farther toner layers contains old toner at a high rate, and such old toner is pressed against the surface of the developing roller 44 by the abutting pressure exerted by the restriction blade 46. This makes the convex sections 441 within the surface of the developing roller 44 exposed to outside the developer carry a great amount of old toner, which leads to scattering of toner, fog, and the like.

In the above embodiment, the distance G1 between the convex sections 441 in the surface of the developing roller 44 and the restriction blade 46 is smaller than double the volume average particle diameter Dave of toner. However, the difference in height between the convex sections 441 and the concave section 442 is not expressly specified. Hence, when the difference in height sufficiently exceeds a toner particle diameter for instance, the concave section 442 carries several toner layers. This is preferable for the purpose of increasing the amount of transported toner. However, this can not be the best from a standpoint of suppressing toner scattering, fog and the like since it is difficult to completely remove old toner contained in these toner layers. Consequently, the following may be exercised in an attempt to further reduce the degree of toner scattering, fog, and the like.

Figure 10A:
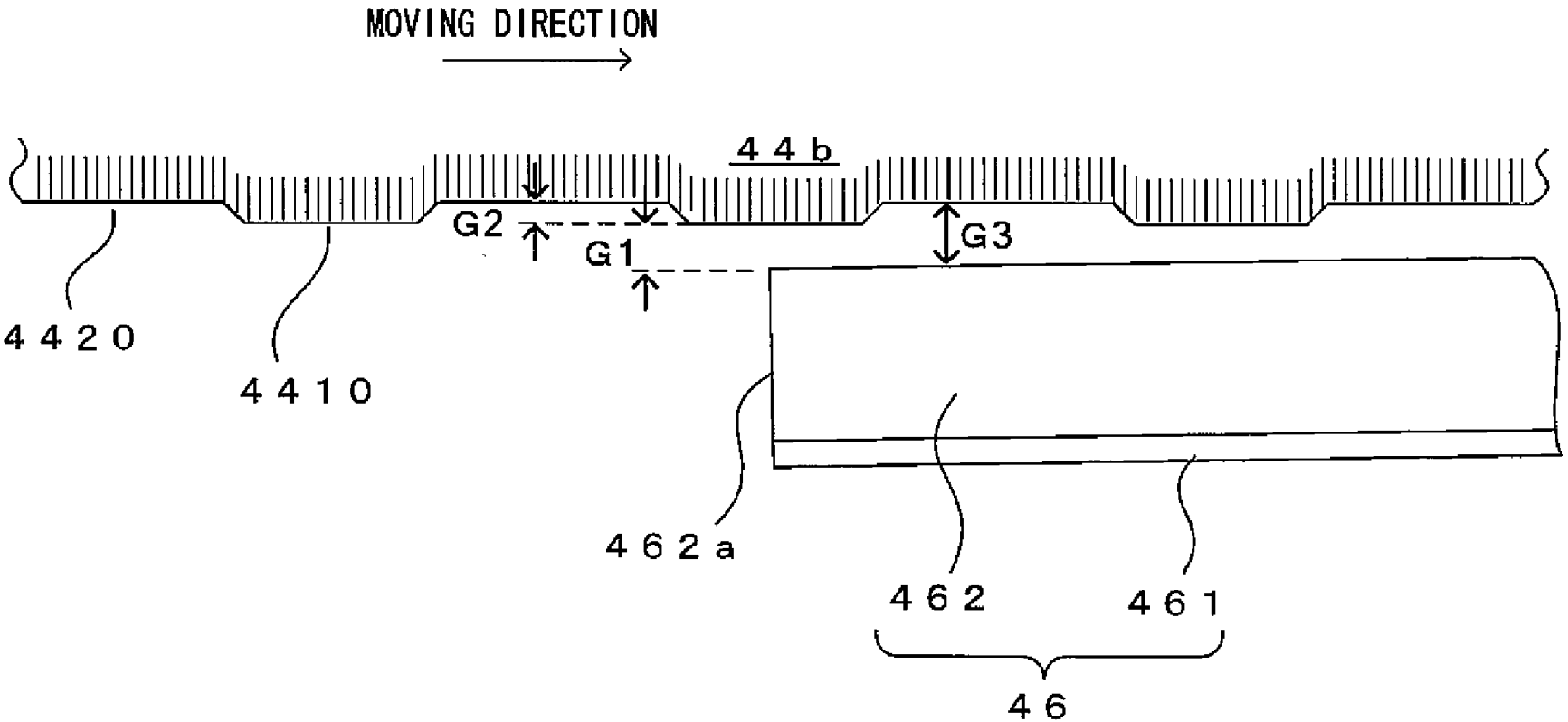
FIGS. 10A and 10B are diagrams showing other embodiment of toner layer restriction.
Figure 10B:
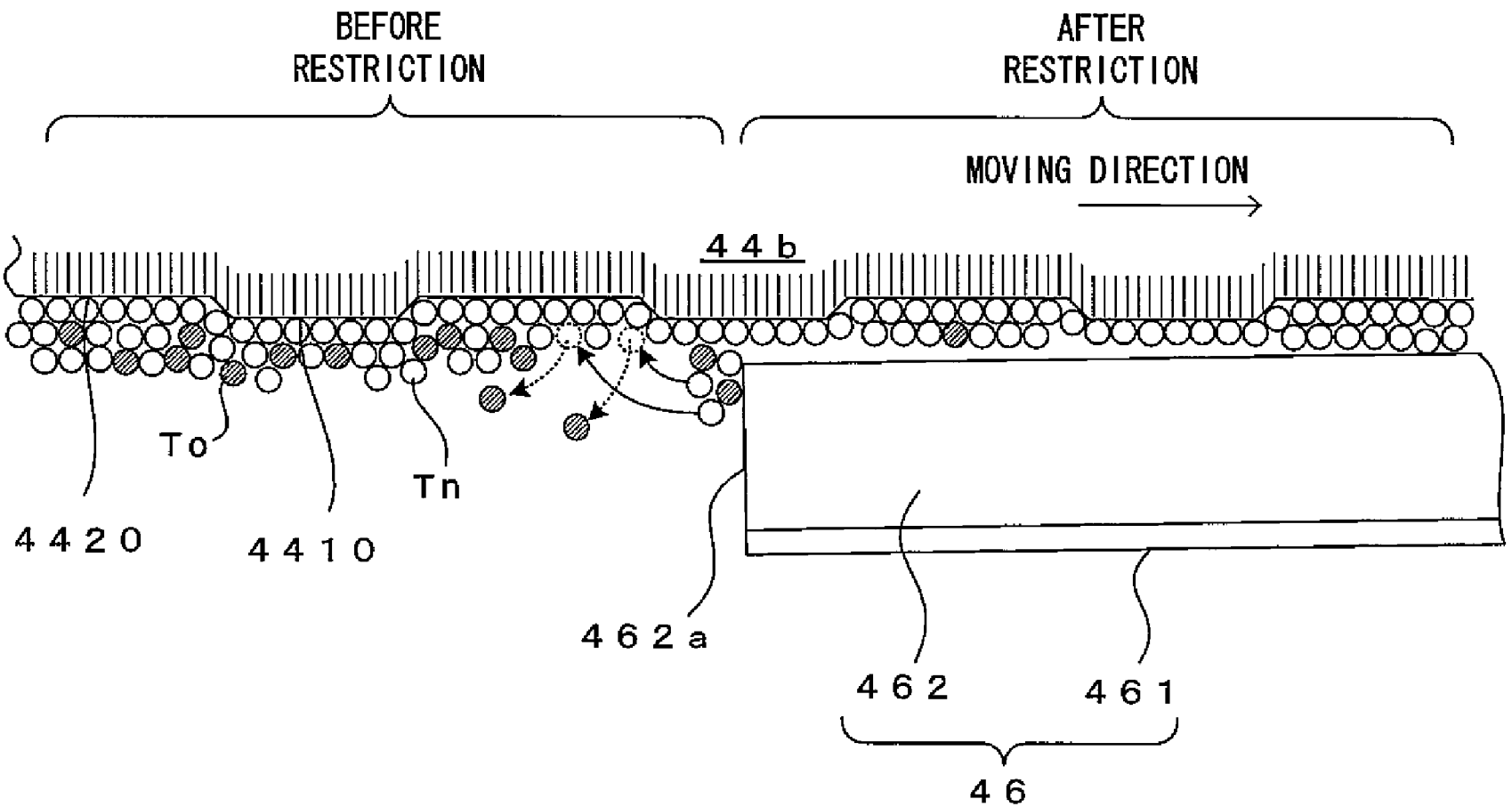

FIGS. 10A and 10B are diagrams showing other embodiment of toner layer restriction. More specifically, FIG. 10A is a diagram showing a positional relationship between a developing roller 44*b* and the restriction blade 46 in this embodiment. FIG. 10B is a diagram schematically showing a condition of toner which is carried on the surface of the developing roller 44*b* in this embodiment.

In this embodiment, the developing roller 44*b* is structured such that the difference in height G2 between convex sections 4410 and concave section 4420 formed in the surface of the developing roller 44*b* is smaller than the volume average particle diameter Dave of toner. Meanwhile, the distance between the convex sections 4410 of the developing roller 44*b* and the restriction blade 46 is a value G1 which is smaller than double the volume average particle diameter Dave of toner, as in the above embodiment. This makes a distance G3 between the concave section 4420 and the restriction blade 46 smaller than triple the volume average particle diameter Dave of toner. Hence, toner layers carried in the concave section 4420 are restricted to less than two layers. Only toner in the layer close to the surface of the developing roller 44*b* is left in this manner. Therefore, the amount of old toner carried on the surface of the developing roller 44*b*, particularly on the concave section 4420, can be further reduced, and hence, it is possible to further reduce the degree of toner scattering, fog, and the like.

Further, the distance G3 between the concave section 4420 of the developing roller 44*b* and the restriction blade 46 may be smaller than double the volume average particle diameter Dave of toner while keeping that the difference in height G2 between the convex sections 4410 and the concave section 4420 is smaller than the volume average particle diameter Dave of toner. Specifically, the distance G1 and the difference in height G2 may be set so as to satisfy the formulae below:

$$G2<\text{Dave}, G3=G1+G2<2\text{Dave} \quad \text{(Formula 2)}$$

This makes the concave section 4420 carry only one toner layer or less. Further, since the first layer contains almost no old toner, it is possible to form a toner layer which is close to the ideal layer shown in FIG. 7.

Next, a description will now be given on a method of determining whether the convex sections 441 of the developing roller 44 carry less than two toner layers. In the above embodiment, the distance between the tip end of the restriction blade 46 and the developing roller 44 is regulated so as to restrict toner layers in the convex sections 441 to one layer or less. However, other approach may be chosen as long as it can ensure that only one toner layer or less covers the convex sections 441. Whether the convex sections 441 carry less than two toner layers may be determined in the following fashion for instance.

Figure 11A:
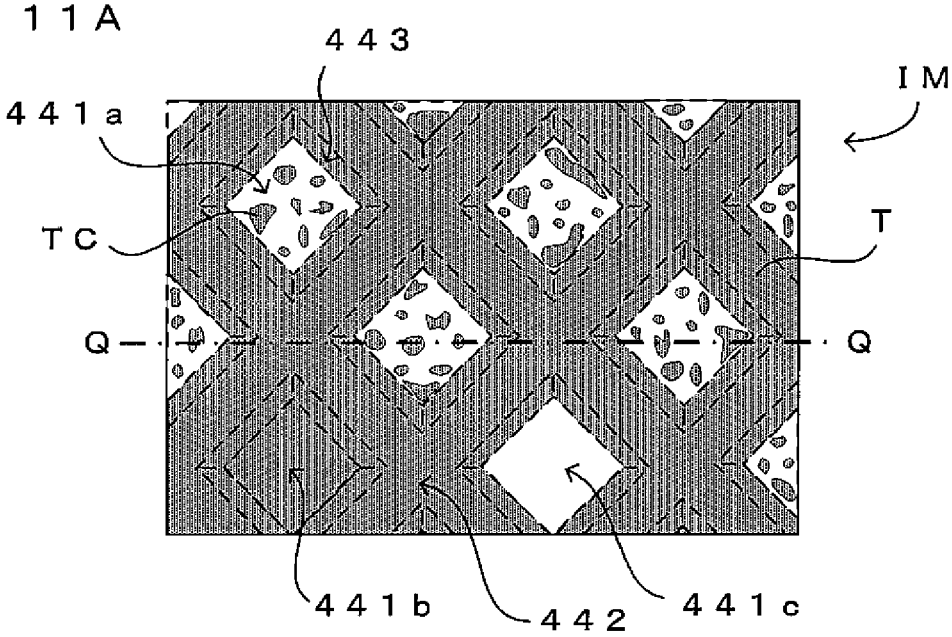
FIGS. 11A and 11B are diagrams showing a state of toner covering the convex sections.
Figure 11B:
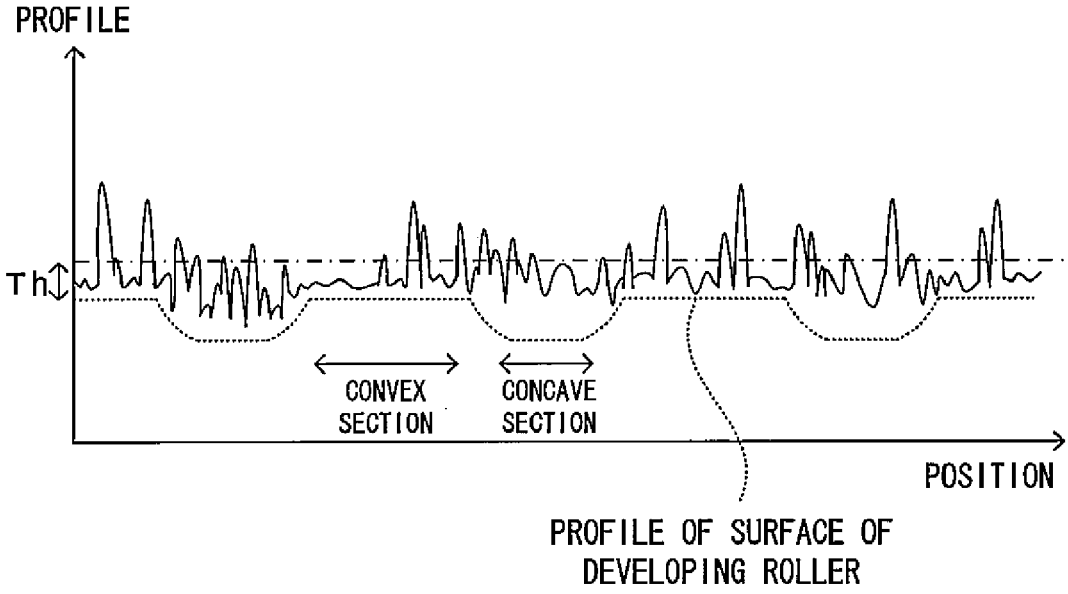

FIGS. 11A and 11B are diagrams showing a state of toner covering the convex sections. When the surface of the developing roller 44 after layer restriction by the restriction blade 46 is enlarged about 1000 times using a laser microscope for instance, an image IM as shown in FIG. 11A is obtained. That is, in the image IM, of the surface of the developing roller, the concave section 442 and side surface portions 443 which connect the convex sections 441 with the concave section 442 are mostly covered with toner T. On the other hand, in the convex sections, the state is greatly different depending upon how to perform layer restriction among:

(1) an instance like the convex section 441*a*, that is, toner lumps TC partially adhere to the convex section 441*a* so that the surfaces of the convex section 441*a* is partially exposed;

(2) an instance like the convex section 441*b*, that is, the convex section 441*b* is completely covered with toner; and (3) an instance like the convex section 441*c*, that is, almost no toner adheres to the convex section 441*c* so that the convex section 441*c* is entirely exposed.

In general, toner tends to adhere to an exposed surface of a developing roller than to a toner layer. Hence, superimposition of toner despite exposure of the surface of the developing roller seems unlikely. Therefore, each toner lump TC is considered to be made of one layer of toner in the instance (1). On the contrary, in the instance (2) that the convex section is completely covered with toner, it is highly possible that two or more layers of toner adhere to the convex section. Hence, ideal states are the instances (1) and (3) and the most ideal state is the instance (1).

At this stage, the rate of the area covered with toner to the area of the top surface of each convex section is called a "convex-section coverage" hereinafter. Consequently, it can be said that a preferable state is where "the convex-section coverage is less than 100%". It should not matter even though the convex-section coverage is 100% as long as there is just one toner layer. However, such is an extremely critical. That is, one should consider that two or more toner layers are carried in the event that the convex sections are completely covered with toner. Hence, the most preferable state in the invention is where the convex-section coverage is less than 100%, that is, the convex sections are not completely covered with toner but the surfaces of the convex sections are at least partially exposed.

A first method for determining this state is a method of visually judging a microscopic image IM as shown in FIG. 11A. Specifically, when the fact that the surfaces of the convex sections are at least partially exposed is visually confirmed in the obtained image IM, it is possible to determine that the convex-section coverage is less than 100%. Since the convex-section coverage varies, some of the convex sections whose surfaces are completely covered with toner and the convex sections whose surfaces are completely exposed like the convex sections 441*b* and 441*c* may be included.

As a second method, the image IM may be binarized through image processing and the state may be determined based on the binary value. For example, reflected light from the respective portions of the surface of the developing roller may be grouped into reflected light from toner and reflected light from the surface of the developing roller based on the levels of the reflected light, and whether the surface of the developing roller is exposed or not may be determined from the grouping result.

A third method may be utilization of a cross section profile of the surface of the developing roller. FIG. 11B is a graph showing an example of a cross section profile which is obtained through scanning along the line Q-Q shown in FIG. 11A. It is to be noted that the waveform itself of the profile in FIG. 11B does not correspond to FIG. 11A. As shown in FIG. 11B, a cross section profile of the surface of the developing roller 44 after layer restriction is performed is obtained, and is compared with a cross section profile of the surface of the developing roller alone. Then, it is possible to determine that toner has adhered to portions where the height from the surface of the developing roller 44 is over a certain threshold value Th. This makes it possible to calculate the convex-section coverage.

From a standpoint of determining whether the top surfaces of the convex sections are partially exposed, instead of the convex-section coverage which is indicative of the rate of the area of toner adhering portions to the area of the top surfaces of the convex sections, evaluation may be made using the rate of the area of exposed portions to the area of the entire surface of the developing roller. This is because the almost entire surface of the developing roller is covered with toner except for the convex sections, and hence, the exposed portions are nearly limited to the convex sections as shown in FIG. 11A.

As described above, in the above embodiments, the developer 4K, . . . corresponds to the "developer apparatus" of the invention, and the housing 41, the developing roller 44 and the restriction blade 46 respectively function as the "container", the "toner carrier roller" and the "restriction member" of the invention. Further, the first chamber 411 and the second chamber 412 inside the developer 4K, . . . correspond to the "toner storage chambers" of the invention. The rotary developer unit 4 which rotates the entire developer and sends toner held in the first chamber into the second chamber functions as the "toner transportation mechanism" of the invention. In the image forming apparatus of the above embodiments, the developer 4K, . . . and the photosensitive member 22 respectively function as the "developer" and the "image carrier" of the invention.

Thus, in the above embodiments, toner layers carried by the convex sections 441 provided within the surface of the developing roller 44 are restricted to one layer or less. This makes it possible to reduce the amount of old toner carried on the convex sections 441. In addition, the distance G1 between the convex sections 441 in the surface of the developing roller 44 and the restriction blade 46 is smaller than double the volume average particle diameter Dave of toner. Hence, old toner contained in toner layers is replaced with new toner which is scraped off by the restriction blade 46, thereby reducing the amount of old toner carried on the concave section 442 as well. This makes it possible to reduce the amount of old toner which is transported to outside the developer with the rotation of the developing roller 44. As a result, according to the above embodiments, it is possible to greatly reduce scattering of toner to outside the developer, fog, and the like.

To realize such toner layer restriction, the distance between the upstream-side edge of the restriction member in the rotation direction of the toner carrier roller and the convex sections within the surface of the toner carrier roller is set to be smaller than double the volume average particle diameter of toner for instance. According to such a structure, of toner adhering to the convex sections within the surface of the toner carrier roller, the restriction member scrapes off toner in the second and farther layers but not the first layer which has directly adhered to the surface of the toner carrier roller. Thus scraped toner contains new toner which has a high charge level, and this highly charged toner replaces old toner which is present near the surface of the toner carrier roller and has a low charge level. Old toner is removed in this manner from near the surface of the toner carrier roller, which makes it possible to reduce old toner adhering to the toner carrier roller. Hence, it is possible to suppress toner scattering from the toner carrier roller, the occurrence of fog, and the like.

Further, the difference in height between the convex sections and the concave section within the surface of the toner carrier may be set to be smaller than the volume average particle diameter of toner. Degraded toner easily enters the concave section when the difference in height between the convex sections and the concave section within the surface of the toner carrier is large. In particular, when the difference in height is equal to or larger than the volume average particle diameter of toner, old toner is likely to adhere to new toner which has directly adhered to the concave section. On the contrary, when the difference in height between the convex sections and the concave section is smaller than the volume average particle diameter of toner, old toner adhering to the concave section gets exposed to the surface of the toner carrier roller and is likely to be scraped off by the restriction member. This reduces the amount of old toner remaining on the surface of the toner carrier roller, and hence, it is possible to suppress the scattering of toner, the occurrence of fog, and the like.

Further, the distance between the upstream-side edge of the restriction member in the rotation direction of the toner carrier roller and the concave section within the surface of the toner carrier roller may be set to be smaller than double the volume average particle diameter of toner. This regulates the toner layer thicknesses in both the convex sections and the concave section of the toner carrier roller to less than two layers. Hence, it is possible to reduce the amount of old toner adhering to the surface of the toner carrier roller.

Further, the surface of the toner carrier roller may be made of a conductive material. According to experiments performed by the inventors of the invention, the layer separation phenomenon above, namely, the phenomenon that a layer mainly containing new toner and a layer mainly containing old toner are layered one atop the other on the surface of the toner carrier roller is particularly obvious when the surface of the toner carrier roller is made of a conductive material. Application of the concept of the invention to a developer apparatus having such a structure would be more effective.

The effect of the invention is also remarkable when the container includes a slot for replenishing toner from outside. A developer apparatus having such a structure could give rise to a phenomenon that a great amount of new toner is introduced through the slot upon old toner which has been used for long time and is stored inside the container. The above layer separation phenomenon would easily occur in such an instance, thereby causing toner scattering, fog, and the like. Application of the concept of the invention to a developer apparatus having such a structure would suppress toner scattering, fog and the like.

This remains unchanged in a structure which comprises a toner transportation mechanism, wherein the container includes a plurality of toner storage chambers which store toner, the surface of the toner carrier roller is at least partially exposed inside one of the toner storage chambers, and the toner transportation mechanism transports toner housed in other toner storage chamber to the one toner storage chamber. This is because new toner is fed onto old toner which is present near the toner carrier roller from other toner storage chamber in this structure as well.

Further, in the event that the volume average particle diameter of toner is 5 μm or larger, the van der Waals attraction acting among toner is weak and toner therefore rolls well, which would lead to layer separation phenomenon. In addition, since the van der Waals attraction is weak, leakage and scattering of toner increase when the layer separation phenomenon occurs. The effect of the invention is therefore particularly significant in the case where such toner is used.

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting. The convex sections may be shaped differently such as circles and triangles for instance.

Although the developing roller 44 is metallic cylinder in the above embodiments, the invention is also applicable to an apparatus comprising a developing roller made of other material. However, experiments performed by the inventors of the invention have identified that layer separation phenomenon described above would be remarkable when a developing roller whose surface is made of a conductive material such as a metallic developing roller and a developing roller made of non-metal with metal-plating thereon is used. Hence, the invention would be very effective when applied to an apparatus comprising a developing roller which has such a conductive surface. In this respect, the invention is also effective to an apparatus comprising a developing roller which is made conductive by dispersing a conductive material such as carbon black and metallic fine powder in a cylinder made of rubber, resin or the like for instance.

Further, although the restriction blade 46 is prepared by attaching the elastic member 462 made of resin to a plate-like member 461 made of metal in the embodiment above, this structure is not limiting. The restriction blade may be a plate of metal alone or a metal plate coated with resin, for example. In addition, an appropriate bias potential may be applied to the restriction blade.

While toner for use in the above embodiments is not specifically limited, the effect of the invention is particularly significant when monocomponent toner whose change in charging characteristics with time is relatively great is used. Further, toner whose particle diameter is 5 μm or larger and which exhibits weak van der Waals attraction, or toner in which the coverage of an additive over core particles of toner is 100% or more in particular has a high flowability, and hence, toner separation phenomenon easily occurs, and leakage and scattering of toner are increased. When applied to an apparatus which uses such toner, the invention is exceptionally effective.

The image forming apparatus in the above embodiment is a color image forming apparatus in which the developers 4K, . . . are attached to the rotary developer unit 4 and toner inside the developers is mixed when the developers 4K, . . . rotate. However, the application of the invention is not limited to this as mentioned earlier. The invention is also applicable to a monochromatic image forming apparatus which includes only one developer and forms a monochromatic image for example. Further, the invention is favorably applied to an image forming apparatus which uses a developer having the following structure as well.

Figure 12:
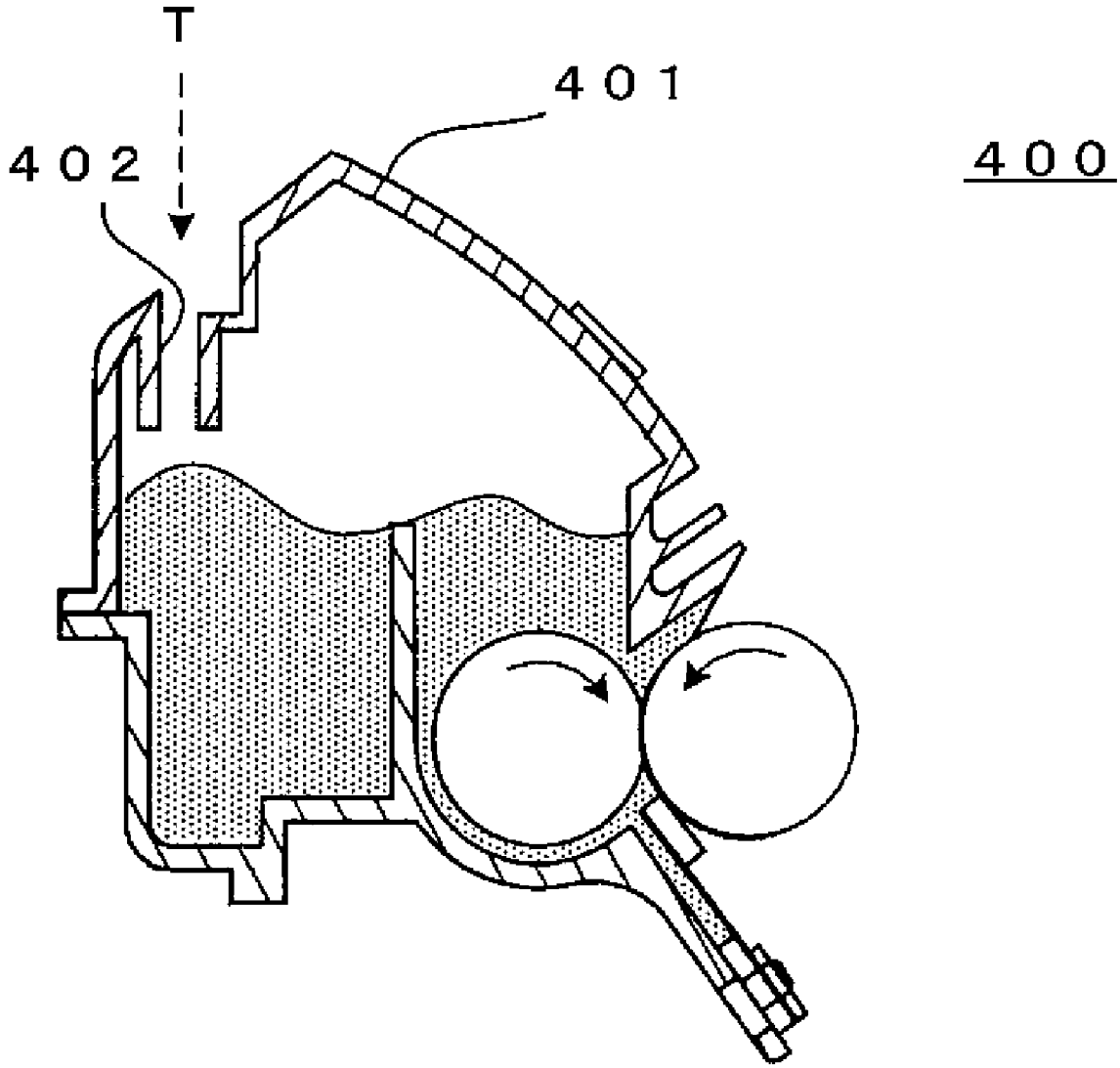
FIG. 12 is a diagram showing other embodiment of a developer.

FIG. 12 is a diagram showing other embodiment of a developer which can be used in the image forming apparatus according to the invention. A developer 400 in this embodiment includes a toner replenishing slot 402 opening in a top section of a housing 401, and it is possible to supply toner T via the toner replenishing slot 402 from a toner tank or an external toner supply source not shown. Immediately after replenishment of toner, the developer 400 having this structure tends to give rise to layer separation phenomenon due to a difference between characteristics of new replenished toner and those of old toner remaining inside the developer. Therefore, when the invention is applied to an image forming apparatus which includes such a developer, it is possible to effectively suppress leakage, scattering and the like of toner.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a container which houses toner;

a toner carrier roller which is provided, on a surface thereof, with a plurality of convex sections which are regularly arranged and a concave section which surrounds the convex sections, is shaped approximately like a cylinder, and rotates while carrying a toner layer of charged toner supplied from the container on the surface thereof; and a restriction member which abuts on the toner layer on the surface of the toner carrier roller to restrict a thickness of the toner layer, and restricts the toner layer carried by the convex sections within the surface of the toner carrier roller to one layer or less, wherein a distance between an upstream-side edge of the restriction member in a rotation direction of the toner carrier roller and the convex sections within the surface of the toner carrier roller is set to be smaller than double a volume average particle diameter of toner.

2. The developer apparatus of claim 1, wherein a difference in height between the convex sections and the concave section within the surface of the toner carrier is smaller than a volume average particle diameter of toner.

3. The developer apparatus of claim 1, wherein the convex sections are so constructed and arranged that top surfaces of the convex sections coincide with a part of a curved surface of a single cylinder.

4. The developer apparatus of claim 1, wherein a distance between an upstream-side edge of the restriction member in a rotation direction of the toner carrier roller and the concave section within the surface of the toner carrier roller is set to be smaller than double a volume average particle diameter of toner.

5. The developer apparatus of claim 1, wherein the surface of the toner carrier roller is made of a conductive material.

6. The developer apparatus of claim 1, wherein the container is provided with a replenishing slot through which toner is replenished from outside.

7. The developer apparatus of claim 1, comprising a toner transportation mechanism, wherein the container includes a plurality of toner storage chambers which store toner, the surface of the toner carrier roller is at least partially exposed inside one of the toner storage chambers, and the toner transportation mechanism transports toner to the one toner storage chamber from other toner storage chamber.

8. The developer apparatus of claim 1, wherein a volume average particle diameter of toner is 5 μm or larger.

9. The developer apparatus of claim 1, wherein the toner includes an additive in addition to a toner particle, and a rate of an area of a surface of the toner particle covered with the additive to a surface area of the toner particle is 100% or more.

10. An image forming apparatus, comprising:

an image carrier which carries an electrostatic latent image; and a developer which develops the electrostatic latent image carried by the image carrier with toner and includes a toner carrier roller which is provided, on a surface thereof, with a plurality of convex sections which are regularly arranged and a concave section which surrounds the convex sections, is shaped approximately like a cylinder, and carries a toner layer of charged toner on the surface thereof; and a restriction member which abuts on the toner layer on the surface of the toner carrier roller to restrict a thickness of the toner layer, wherein the toner layer carried by the convex sections within the surface of the toner carrier roller is comprised of one layer or less, and a distance between an upstream-side edge of a restriction member in a rotation direction of the toner carrier roller and the convex sections within the surface of the toner carrier roller is set to be smaller than double a volume average particle diameter of toner.

11. A developing method, comprising:

arranging an approximately cylindrical toner carrier roller, which carries a toner layer of charged toner on a surface thereof, opposed to an image carrier which carries an electrostatic latent image, the toner carrier roller being provided, on the surface thereof, with a plurality of convex sections which are regularly arranged and a concave section which surrounds the convex sections;

arranging a restriction member to abut and restrict a thickness of the toner layer, wherein a distance between an upstream-side edge of the restriction member in a rotation direction of the toner carrier roller and the convex sections within the surface of the toner carrier roller is set to be smaller than double a volume average particle diameter of toner;

developing the electrostatic latent image carried by the image carrier with toner; and restricting the toner layer carried by the convex sections within the surface of the toner carrier roller to one layer or less.

* * * * *